United States Patent [19]

Lapatovich et al.

[11] Patent Number: 4,636,692

[45] Date of Patent: Jan. 13, 1987

[54] MERCURY-FREE DISCHARGE LAMP

[75] Inventors: Walter P. Lapatovich, Hudson, Mass.; George R. Gibbs, Nesconset, N.Y.

[73] Assignee: GTE Laboratories Incorporated, Waltham, Mass.

[21] Appl. No.: 647,081

[22] Filed: Sep. 4, 1984

[51] Int. Cl.[4] ..... H05B 41/16; H05B 41/24

[52] U.S. Cl. ..... 315/248; 313/637; 313/638; 313/643

[58] Field of Search ..... 315/248; 313/637, 638, 313/640, 642, 643

[56] References Cited

U.S. PATENT DOCUMENTS

| | | | |
|---|---|---|---|
| 2,765,416 | 10/1956 | Beese et al. | 313/13 |
| 3,586,898 | 6/1971 | Speros et al. | 313/637 |
| 4,002,922 | 1/1977 | Young | 315/248 |
| 4,206,387 | 6/1980 | Kramer et al. | 315/248 |
| 4,436,762 | 3/1984 | Lapatovich et al. | 427/39 |
| 4,480,213 | 10/1984 | Lapatovich et al. | 315/248 |
| 4,492,898 | 1/1985 | Lapatovich et al. | 313/637 |
| 4,532,455 | 7/1985 | Connor et al. | 313/637 |
| 4,549,109 | 10/1985 | Nighan et al. | 313/637 |

*Primary Examiner*—Saxfield Chatmon

*Attorney, Agent, or Firm*—Martha Ann Finnegan; Frances P. Craig

[57] ABSTRACT

An ultraviolet light source includes a volume filled with a dose of $AlBr_3$ and an inert gas. No mercury is used. During electrical discharge excited states of $AlBr_2$, and AlBr emit light, with AlBr having a broad ultraviolet emission peaking at about 278 nm. The source may be energized with or without internal electrodes. Phosphors may be employed to convert the ultraviolet to visible light. The lamp's envelope may be aluminosilicate coated quartz.

10 Claims, 6 Drawing Figures

MERCURY-FREE DISCHARGE LAMP

REFERENCE TO RELATED APPLICATION

U.S. Pat. Application Serial No. 647,080 filed on even date herewith for Compact Mercury-Free Fluorescent Lamp divulges a compact fluorescent lamp containing a mercury-free fill of aluminum tribromide.

BACKGROUND OF THE INVENTION

This invention pertains to electromagnetic discharge devices and, more particularly, is concerned with ultraviolet light sources.

Perhaps the most familiar electromagnetic discharge ultraviolet source is the common fluorescent lamp. Usually the lamp has a cylindrical envelope filled with low pressure inert gas (e.g., argon) and a small dose of metallic mercury. Voltage applied to electrodes within the envelope accelerates electrons which ionize the inert gas, initiating a discharge. Heat and electrons from the discharge vaporize and excite the mercury which emits ultraviolet and visible radiation, with a strong ultraviolet line at 253.7 nm. A phosphor layer inside the envelope converts the ultraviolet to visible light.

Many modifications have been proposed to improve the conventional fluorescent lamp. Departing from a straight tube configuration, envelopes have been formed into toroids, spheriods, re-entrant cavities, and many other configurations. Beam shaping electrodes have been demonstrated, as have electrodeless discharges. Most of these modifications, however, call for mercury in the discharge medium.

Effort has also been made to improve the filling. For examples, U.S. Pat. No. 4,427,921 issued January 24, 1984 to Proud et al for "Electrodeless Ultraviolet Light Source" discloses fillings including I, $HgI_2$, and $CdI_2$, and U.S. Pat. No. 4,427,922 to Proud et al for "Electrodeless Light Source" describes fillings including $HgI_2$, $HgBr_2$, and $HgCl_2$.

In the related art of high pressure mercury vapor lamps it has been known for a number of years to improve the visible output of such lamps by adding metal halides to a filling of mercury and inert gas. U.S. Pat. No. 3,586,898 "Aluminum Chloride Discharge Lamp" issued to Speros and Simper divulges a filling of aluminum trichloride, mercury, and inert gas with the optional addition of aluminum tri-iodide. The lamp envelope is either alumina or alumina coated quartz to avoid reaction between $AlCl_3$ and $SiO_2$.

Mercury and cadmium are known to accumulate in biological systems and are hazards to human health. While the dosage of these metals expected from individual lamps is likely to be below the threshold of harm, it would be desirable to avoid their use if an alternative efficient fill material were available.

Accordingly, it is an object of this invention to provide an efficient discharge ultraviolet light source having fillings free of mercury or cadmium. Another object is to provide an ultraviolet lamp source having greater radiant intensity than a mercury lamp of the same physical size.

SUMMARY OF THE INVENTION

Briefly a discharge lamp in accordance with the present invention includes a discharge chamber filled with inert gas and a dose of aluminum tribromide which supports an electrical discharge and emits ultraviolet and visible light. The aluminum tribromide may be vaporized by the heat of the excited inert gas. In one embodiment the inert gas is neon at a pressure of about 2 torr and the aluminum tribromide has a vapor pressure of 1 torr. As a feature of the invention, the discharge chamber may be made of quartz internally coated with alumina silicate. Furthermore, the wall of the chamber may be coated with a layer of phosphor to convert the ultraviolet light to visible light. The lamp may be energized by radio frequency energy, or via internal electrodes.

DESCRIPTION OF THE INVENTION

Figure 1:
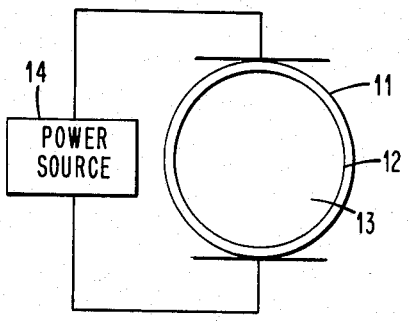
FIG. 1 schematically represents a generalized ultraviolet source embodying the invention.

FIG. 1 shows a generalized high intensity, ultraviolet source 10 according to the invention. The source is characterized by a molecular discharge to produce intense ultraviolet radiation. The specific molecule is AlBr dissociated from aluminum tribromide ($AlBr_3$). Mercury or cadmium is not used.

A vessel 11 defines a discharge chamber 12, which contains a filling 13 of aluminum tribromide vapor and one or more inert gases, preferably neon (Ne). Electrical energy from electrical power source 14 is coupled into the discharge chamber. It has been found that when the pressures of the aluminum tribromide vapor and neon are within a broad range, the mixture can sustain an electrical discharge at moderate power densities (20–80 W/cm$^3$). The pressure of the vapor can be in the range of 0.2 torr to 20 torr. The preferred pressures are 1 torr of $AlBr_3$ vapor and 2 torr of Ne.

During discharge the components of the mixture become excited into a plasma state characterized by a high electron temperature. Several plasma reactions occur which produce ultraviolet and visible light.

Figure 2:
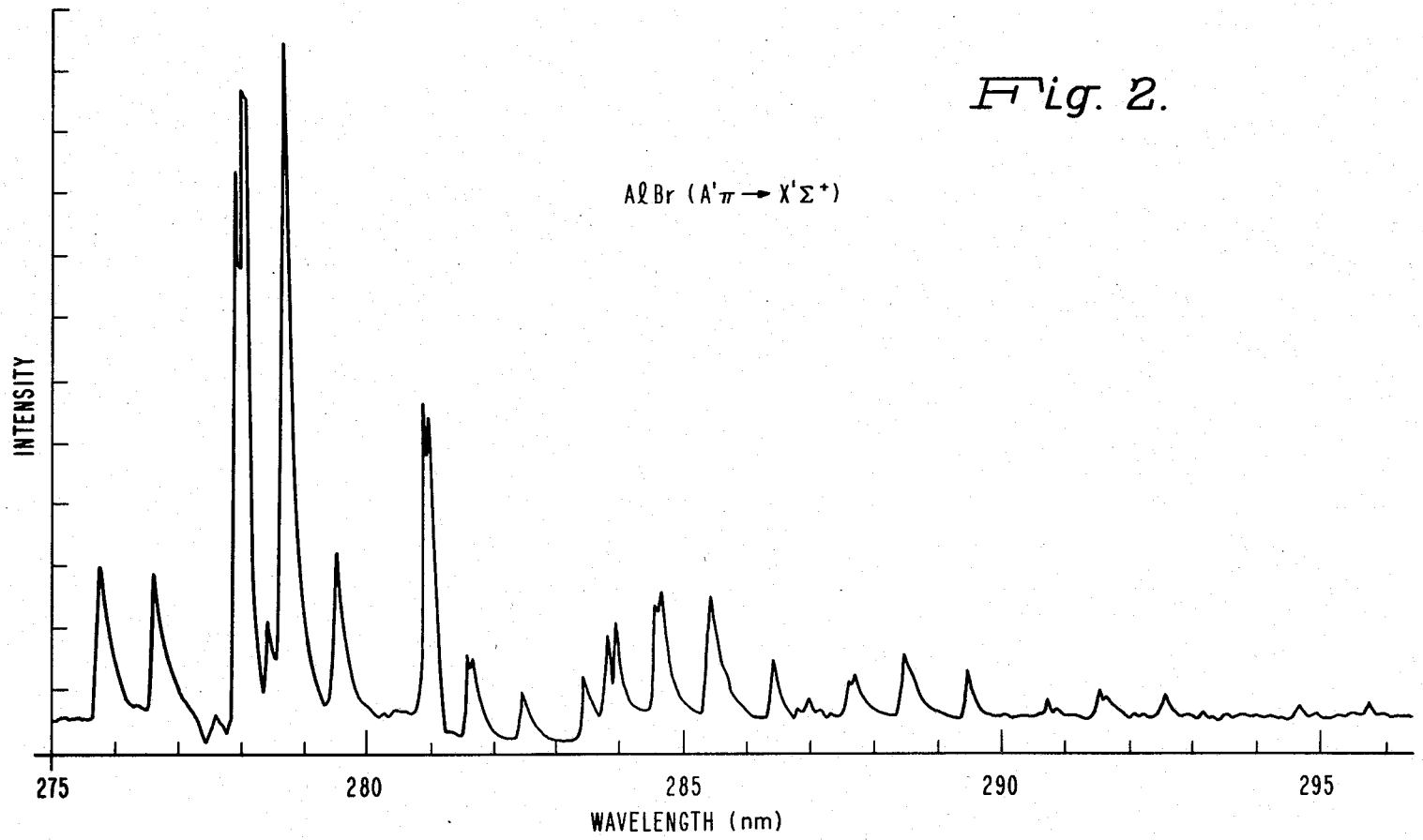
FIG. 2 is a spectrogram of ultraviolet light emitted by the source of FIG. 1.
Figure 3:
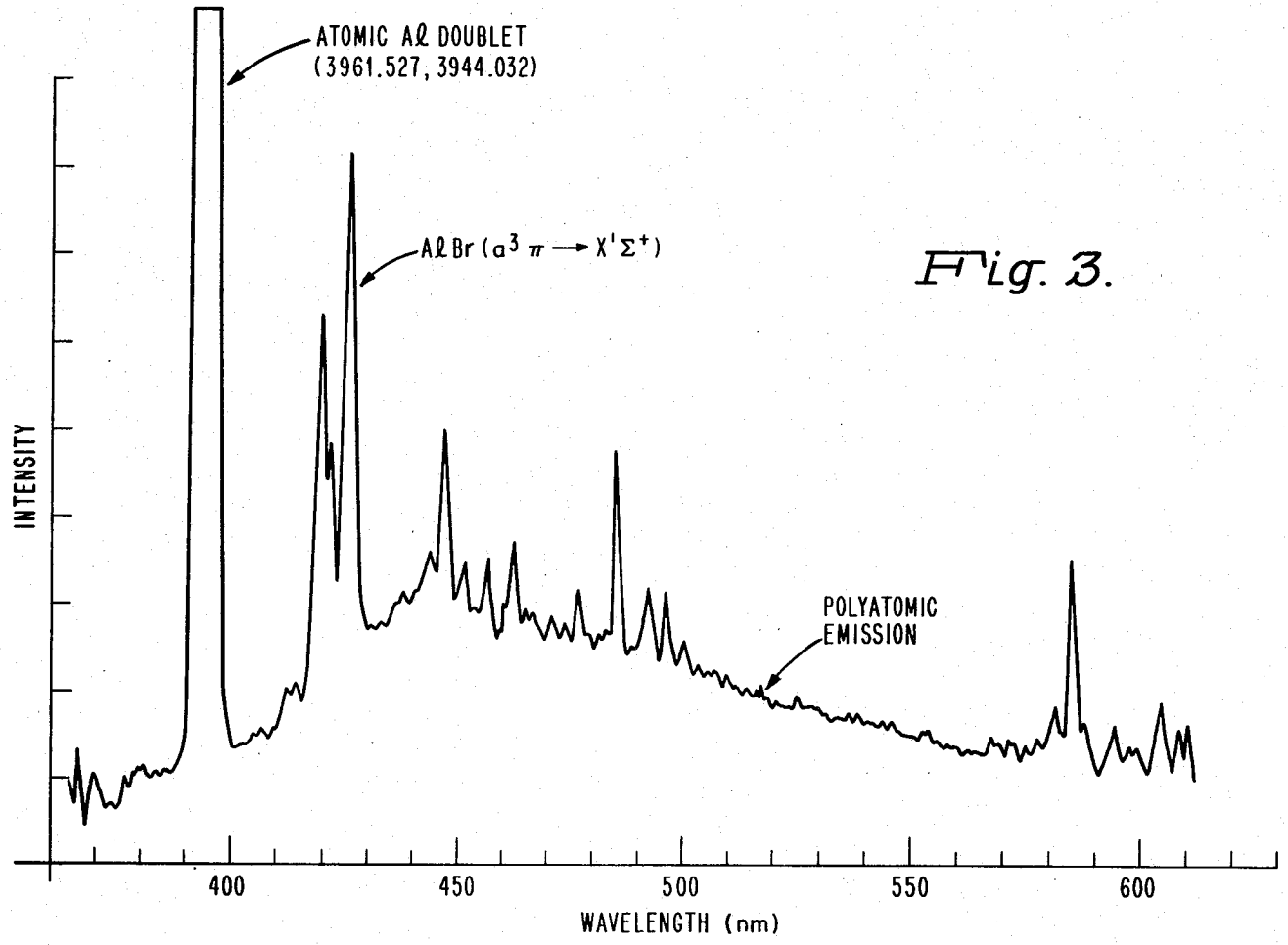
FIG. 3 is a spectrogram of visible light emitted by the source of FIG. 1.

The observed ultraviolet spectrum from such a plasma is depicted in FIG. 2 (T ~ 60° C.). The observed visible spectrum from such plasma is depicted in FIG. 3 (T ~ 60° C.). Radiation from excited states of the molecules $AlBr_2$, and AlBr, and atomic Al, is observed. Plasma reactions which can account for these species include the dissociative attachment reactions;

$$AlBr_3 + e^- \rightarrow AlBr_2^* + Br^-$$

$$AlBr_2 + e^- \rightarrow AlBr^* + Br-$$

$$AlBr + e^- \rightarrow Al^* + Br-$$

$$AlBr_2 + e^- \rightarrow Al^* + Br-_2 \qquad (1)$$

Electron collisions with the neon, will produce excited states (Ne*) which can produce excitation exchange with concomitant dissociation similar to those depicted in (1):

$$AlBr_3 + Ne^* \rightarrow AlBr_2^* + Ne + Br$$

$$AlBr_2 + Ne^* \rightarrow AlBr^* + Ne + Br$$

$$AlBr + Ne^* \rightarrow Al^* + Ne + Br$$

$$AlBr_2 + Ne^* \rightarrow Al^* + Ne + Br_2 \quad (2)$$

These reactions are reversible and are constantly occurring under steady state conditions.

Emission from the excited species (denoted by asterisks) in reactions (1) and (2), specifically from AlBr, pertains to the present invention. FIG. 2 shows the ultraviolet band attributable to AlBr: $A^1 \rightarrow X^1\Sigma\times$ near 278 nm to be a spectrally intense feature. This diatomic molecular band has a spectral bandwidth of approximately 50 times as large as the atomic Hg line at 253.7 nm. The peak intensity of the molecular band is less than that of atomic mercury, but the product of peak height times bandwidth (a measure of the UV energy output) may be substantially greater in the molecular case, depending on discharge conditions.

The ultraviolet emission can, if so desired, be converted to visible light by phosphors surrounding the discharge chamber. This is, of course, the principle of fluorescent lamps. The diatomic AlBr ultraviolet emission is capable of exciting several types of phosphors. For example, the UV emission near 278 has been used to excite a conventional triphosphor blend. The fluorescence of the phosphor was observed visually and appeared blue-green, owing to the particular excitation spectra of the phosphor sample. The polyatomic emission from the molecular discharge, as shown in FIG. 3, contributes to the visible light produced by the phosphors.

Commercial embodiments of the lamp may feature either electrodeless discharge or electroded discharge.

Figure 4:
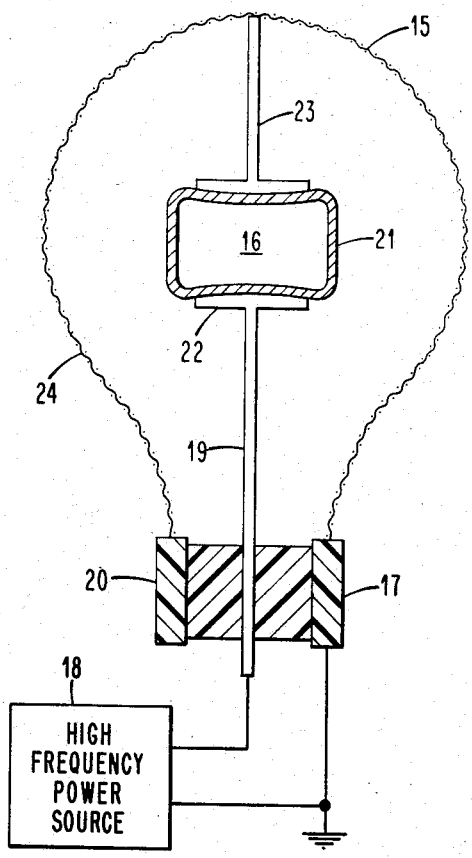
FIGS. 4 and 5 are examples of electrodeless lamps according to the invention.
Figure 5:
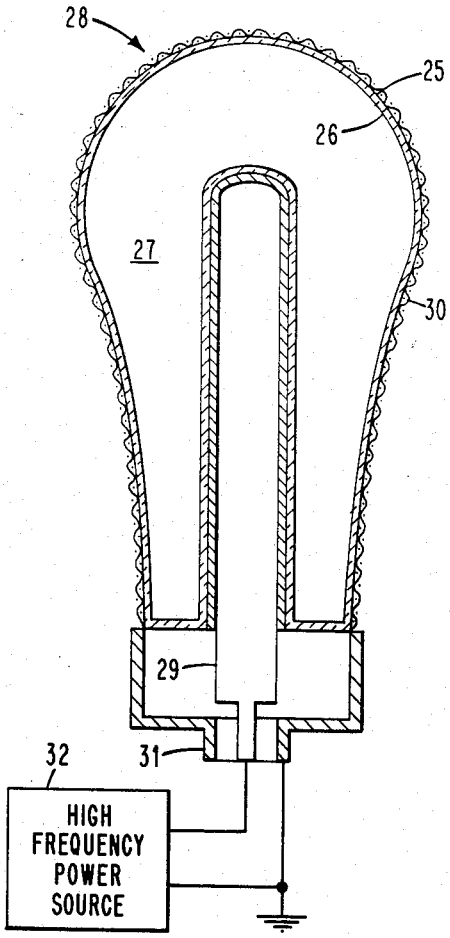

FIGS. 4 and 5 show examples of electrodeless discharge lamps. In FIG. 4 there is seen an electrodeless lamp 15 containing a filling 16. The electrodeless lamp 15 is supported within a coupling fixture 17 which couples power from a high frequency (RF) power source 18, such as a radio frequency oscillator, to the filling of the electrodeless lamp. The electrodeless lamp forms a termination load for the fixture.

The electrodeless lamp 15 has a sealed discharge chamber 21 made of a suitable material which is transparent to ultraviolet radiation, for example, coated quartz or alumina. The filling 16 within the discharge chamber 21 in accordance with the present invention includes aluminum tribromide and a buffer gas. The vapor pressure of the aluminum tribromide after lamp warmup is preferably about 1 torr. The buffer gas such as argon, krypton, xenon, neon, or nitrogen has a pressure preferably about 2 torr.

The coupling fixture 17 includes an inner conductor 19 and an outer conductor 20 disposed around the inner conductor. The outer conductor 20 includes a conductive mesh 24 which acts as a conductor and provides shielding at the operating frequencies while permitting the passage of light radiated from the lamp 15. The lamp 15 is supported between a first metal electrode 22 at one end of the inner conductor 19 and a second metal electrode 23 connected to the outer conductor 20. The other ends of the inner and outer conductors are arranged in a coaxial configuration for coupling to the power source 18. In order to achieve electrodeless discharge it is necessary to employ RF power capable of penetrating the discharge chamber while being absorbed strongly in the low pressure discharge plasma contained therein. The power source 18 preferably is a source of continuous wave RF excitation in the range of from 902 to 928 MHz. Structural details of a similar discharge apparatus is disclosed in U.S. Pat. No. 4,427,920 issued Jan. 24, 1984 to Joseph M. Proud, Robert K. Smith, and Charles N. Fallier entitled "Electromagnetic Discharge Apparatus".

FIG. 5 is a schematic representation of an alternative embodiment of an electromagnetic discharge apparatus 28 in accordance with the present invention. The apparatus 28 includes an electrodeless lamp 25 having a discharge chamber 26 in the shape of a re-entrant cylinder providing a generally annular discharge region 27. The fill material of the lamp includes aluminum bromide as described hereinabove. The RF coupling arrangement includes a center electrode 29 disposed within the internal re-entrant cavity in the discharge chamber 26. An outer conductive mesh 30 surrounds the discharge chamber 26 providing an outer electrode which is transparent to radiation from the lamp. The center electrode 29 and outer mesh 30 are coupled by a suitable coaxial arrangement 31 to a high frequency power source 32. A radio frequency electric field is produced between the center electrode 29 and the outer mesh 30 causing ionization and breakdown of the fill material. Ultraviolet radiation at 278 nm is produced by the resulting glow discharge within the lamp as explained previously. Specific details of the structure of apparatus of this general type are shown in U.S. Pat. No. 4,266,167 which issued May 5, 1981, to Joseph M. Proud and Donald H. Baird entitled "Compact Fluorescent Light Source and Method of Excitation Thereof".

Figure 6:
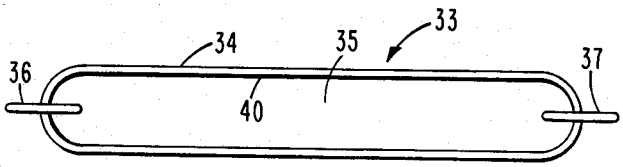
FIG. 6 is an electroded lamp according to the invention.

FIG. 6 shows an example of a lamp 33 utilizing an electrode discharge. The discharge chamber 34 contains a low pressure filling 35 of aluminum bromide and neon as described above. The two electrodes 36, 37 should be made of a noble metal or aluminum so as to minimize reaction with the plasma. Electrodes 36, 37 may be coupled to line voltage. Discharge chamber 34 may be coated with a phosphor coating 40 for converting the ultraviolet light to visible light. The structure is otherwise similar to high pressure metal arc mercury lamps such as disclosed in U.S. Pat. No. 4,158,789 issued June 19, 1979 to Scholz and Gardner.

The discharge chamber of each embodiment is a vessel made of heat resistant transparent material such as fused quartz, or alumina. If less expensive quartz is chosen, the plasma products of aluminum bromide will react with active silicon near the inner surface of the quartz vessel. This reaction, if unchecked, releases highly volatile silicon tetrabromide ($SiBr_4$) which eventually degrades the performance of the lamp. To prevent this problem, the inner walls of the discharge vessel may be precoated with a refractory material.

During manufacture of the lamp the discharge chamber may be charged with a mixture of aluminum bromide and a buffer gas. A discharge is induced through the mixture intentionally causing a plasma reaction with the walls of the discharge vessel. A coating of aluminosilicate ($3Al_2O{\cdot}2SiO_2$) is formed on the inner surface of the vessel. This method of depositing refractory coatings is disclosed in U.S. Pat. No. 4,436,762 issued March 13, 1984 to Lapatovich et al. for "Low Pressure Plasma Discharge Formation of Refractory Coating". The vessel is then evacuated to $10^{-7}$ torr and baked at 1000° C. The vessel is then refilled with fresh aluminum bromide and inert gas and sealed.

An important feature of the invention is the complete elimination of mercury in discharge lamps. The toxic effects of mercury are cummulative and are a subject of environmental concern. The products of a reaction between aluminum bromide and water or steam are likely to promptly degrade. Another important aspect is obviating of lengthy positive column discharge lamps due to a high radiant intensity featured by the source. Thus the invention provides a compact ultraviolet source suitable for UV polymerization and other applications.

While there has been shown and described what are considered preferred embodiments of the present invention, it will be obvious to those skilled in the art that various changes and modifications may be made therein without departing from the invention as defined by the appended claims.

What is claimed is:

1. A mercury free molecular vapor discharge lamp comprising:

a vessel having walls defining a discharge chamber;

a mercury free filling of aluminum tribromide vapor at a pressure of about 0.2 to 20 torr and one or more inert gases in said chamber; and means for causing an electrical discharge through said filling whereupon said filling emits ultraviolet and visible light.

2. A lamp in accordance with claim 1 wherein said inert gas is neon at an ambient pressure of approximately 2 torr and said aluminum tribromide has a vapor pressure of approximately 1 torr.

3. A lamp in accordance with claim 1 wherein said vessel is fused silicon dioxide, the interior of which is coated with a layer of aluminosilicate.

4. A lamp in accordance with claim 1 further comprising a phosphor coating on the wall of said discharge chamber for converting the ultraviolet light to visible light.

5. A lamp in accordance with claim 1 wherein said means for initiating and sustaining an electrical discharge through said filling is a radio frequency oscillator.

6. A mercury free molecular vapor discharge lamp comprising:

a vessel having walls defining a discharge chamber;

said chamber being free of mercury and filled with an inert gas and containing an amount of aluminum tribromide;

means for heating said aluminum tribromide for generating aluminum bromide vapor at a pressure from about 0.2 to 20 torr causing a mixture of said inert gas and said aluminum bromide vapor to fill said discharge chamber; and means for initiating and sustaining an electrical discharge through said mixture which in response emits ultraviolet and visible light.

7. A lamp in accordance with claim 6 wherein said inert gas is neon at an ambient pressure of approximately 2 torr and said aluminum tribromide has a vapor pressure of approximately 1 torr.

8. A lamp in accordance with claim 6 wherein said vessel is fused silicon dioxide, the interior of which is coated with a layer of aluminosilicate.

9. A lamp in accordance with claim 6 further comprising a phosphor coating on the wall of said discharge chamber for converting the ultraviolet light to visible light.

10. A lamp in accordance with claim 6 wherein said means for initiating and sustaining an electrical discharge through said filling is a radio frequency oscillator.

* * * * *